US008922123B2

(12) United States Patent
Liu et al.

(10) Patent No.: US 8,922,123 B2
(45) Date of Patent: Dec. 30, 2014

(54) LIGHT-EMITTING DEVICE AND CONTROL METHOD OF THE SAME

(71) Applicant: Delta Electronics, Inc., Taoyuan Hsien (TW)

(72) Inventors: Bao-Kim Liu, Taoyuan Hsien (TW); Ting-Lung Hsiao, Taoyuan Hsien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 13/954,070

(22) Filed: Jul. 30, 2013

(65) Prior Publication Data

US 2014/0210349 A1 Jul. 31, 2014

(30) Foreign Application Priority Data

Jan. 30, 2013 (TW) ..... 102103476 A

(51) Int. Cl.
*H05B 37/03* (2006.01)
*H05B 33/08* (2006.01)

(52) U.S. Cl.
CPC ..... *H05B 37/036* (2013.01); *H05B 33/0824* (2013.01); *H05B 33/089* (2013.01)
USPC ..... 315/122; 315/291; 315/185 R

(58) Field of Classification Search
CPC ..... H05B 37/00; H05B 37/02; H05B 37/03
USPC ..... 315/122, 291, 185 R
See application file for complete search history.

(56) References Cited

U.S. PATENT DOCUMENTS

| | | | |
|---|---|---|---|
| 6,288,497 | B1 | 9/2001 | Chang et al. |
| 7,973,877 | B2 | 7/2011 | Takeda et al. |
| 2002/0043943 | A1 | 4/2002 | Menzer et al. |
| 2010/0123403 | A1 | 5/2010 | Reed |

FOREIGN PATENT DOCUMENTS

| | | | |
|---|---|---|---|
| JP | 2003-529190 | | 9/2003 |
| JP | 2007-123562 | | 5/2007 |
| JP | 2009-38247 | | 2/2009 |
| JP | 2012-509558 | | 4/2012 |
| JP | 2012-182010 | | 9/2012 |
| TW | 201206251 | A1 | 2/2012 |
| WO | 2007080984 | | 7/2007 |

*Primary Examiner* — Tung X Le
*Assistant Examiner* — Jonathan Cooper
(74) *Attorney, Agent, or Firm* — Lowe Hauptman & Ham, LLP

(57) ABSTRACT

A light-emitting device control method is provided. The light-emitting device control method comprises the steps outlined below. A light-emitting module of a light-emitting device having light-emitting unit string each having light-emitting units connected in series is operated. One end of each light-emitting unit strings receives a same DC voltage. A voltage drop value across each current control units connected in series to at least one of the light-emitting unit strings is retrieved to further determine whether the light-emitting unit of each of the light-emitting unit strings malfunctions. When x light-emitting units of a specific string malfunction and x is larger than or equal to a malfunction threshold value p, the x malfunctioned light-emitting units are shorted and (x−p+1) light-emitting units in each of the light-emitting unit strings other than the specific string are shorted. The DC voltage received by each of the light-emitting units is decreased.

18 Claims, 5 Drawing Sheets

LIGHT-EMITTING DEVICE AND CONTROL METHOD OF THE SAME

RELATED APPLICATIONS

This application claims priority to Taiwan Application Serial Number 102103476, filed Jan. 30, 2013, which is herein incorporated by reference.

BACKGROUND

1. Technical Field

The present disclosure relates to the light-emitting module control technology, and in particular, to a light-emitting device and control method thereof.

2. Description of Related Art

Solid state light-emitting units, such as a light-emitting diode (LED), that is used for the backlight source of the display panel or the light source used for illumination gradually become the mainstream technology. In a backlight source of a display panel, for example, light-emitting units are usually integrated into a module, so as to provide a uniform light source for the display panel, in which the module includes light-emitting units connected in series. However, in the module mentioned above, the light-emitting units may malfunction. When one of the light-emitting units connected in series fails, the original voltage drop value of the malfunctioned light-emitting unit is transferred to other units in the same string. Therefore, when the number of malfunctioned light-emitting units increases, the transferred voltage drop value rises and may easily damage other units.

To prevent the occurrence of the above situation, the entire string of light-emitting units is turned off when the number of malfunctioned light-emitting units reaches a predetermined value in the conventional method. However, when the entire string of light-emitting units is turned off because of a small amount of malfunctioned light-emitting units, the brightness of the light source is significantly reduced, which adversely affects the operating efficiency.

Therefore, it becomes an urgent problem to be solved in this technical field to design a new light-emitting device and method in which a flexible adjustment mechanism is provided to prevent the significant reduction of brightness of the light source when the light-emitting unit malfunctions.

SUMMARY

Therefore, an aspect of the present disclosure is to provide a light-emitting device, which includes: a light-emitting module, a plurality of current control units and a control module. The light-emitting module includes a plurality of light-emitting unit strings, each of the light-emitting unit strings includes a plurality of light-emitting units connected in series, and an end of each of the light-emitting unit strings receives a same DC voltage. Each of the current control units is connected in series to at least one of the light-emitting unit strings, so as to control a current of each of the light-emitting unit strings. The control module retrieves a voltage drop value across each of the current control units, so as to further determine whether the light-emitting units in each of the light-emitting unit strings malfunction; and when light-emitting units of a specific string among the light-emitting unit strings malfunction, and the number x of malfunctioned light-emitting units is larger than or equal to a malfunction threshold value p, the control module shorts the malfunctioned light-emitting units in the specific string and shorts (x−p+1) light-emitting units in each of the light-emitting unit strings other than the specific string and decrease the DC voltage received by each of the light-emitting unit strings, thereby achieving the effect of reducing the power consumption of the current control units.

According to an embodiment of the present disclosure, the number m of the light-emitting unit strings is smaller than the number n of the light-emitting units included in each of the light-emitting unit strings. When the control module determines that the number (m−1)*(x−p+1) of the shorted light-emitting units of all light-emitting unit string other than the specific string is larger than or equal to the number (n−x) of the light-emitting units which are not shorted in the specific string, the control module turns off the specific string.

According to another embodiment of the present disclosure, each of the light-emitting units further includes a light-emitting element and a parallel switch, and the control module shorts the corresponding light-emitting element by enabling the parallel switch.

According to yet another embodiment of the present disclosure, the control module stores a reference table to record at least one shorted light-emitting unit in each of the light-emitting unit strings and whether the shorted light-emitting unit malfunctions. The control module determines whether one of the normally operating light-emitting units in the specific string is shorted when the control module shorts the specific string, so as to reconnect the normally operating one when the normally operating one is shorted. The control module further determines whether there is at least one normally operating light-emitting unit shorted in the light-emitting units of the specific string according to the reference table, so that when the number k of the normally operating light-emitting unit is smaller than or equal to x, the normally operating light-emitting unit is reconnected, and when k is larger than x, the x normally operating light-emitting unit is reconnected. The control module shorts one of the light-emitting units of the specific string in order, and determines whether the normally operating light-emitting unit is shorted according to the voltage drop value across the current control unit.

According to further an embodiment of the present disclosure, the control module determines whether there is a shorted light-emitting unit in the light-emitting units in each of the light-emitting unit strings other than the specific string according to the reference table when each of the light-emitting unit strings other than the specific string is to be shorted, when the number q of the shorted light-emitting unit is larger than or equal to (x−p+1), the control module does not perform shorting, and when the number q of the shorted light-emitting unit among the light-emitting units is smaller than (x−p+1), the control module shorts the (x−p+1−q) light-emitting units which are not shorted.

According to another embodiment of the present disclosure, when a malfunction condition is occurred in y light-emitting unit strings, the number of malfunctioned light-emitting units is z, and the condition of $((m-1)*(x-p+1)-z) \geq ((n-x)*y+(p-1)*(y-1))$ is met, the control module turns off the y light-emitting unit strings.

Another aspect of the present disclosure is to provide a light-emitting device control method, which includes: operating a light-emitting module of a light-emitting device, in which the light-emitting module includes a plurality of light-emitting unit string, each of the light-emitting unit strings includes a plurality of light-emitting units connected in series, and an end of each of the light-emitting unit strings receives a same DC voltage; retrieving a voltage drop value across each of a plurality of current control units, so as to further determine whether light-emitting units in each of the light-emitting unit strings malfunction, in which each of the current control units and one of the light-emitting unit string are connected in series; and when light-emitting units of a specific string among the light-emitting unit strings malfunction, and the number x of malfunctioned light-emitting units is larger than or equal to a malfunction threshold value p, shorting the malfunctioned light-emitting units in the specific string and shorting (x−p+1) light-emitting units in each of the light-emitting unit strings other than the specific string, so as to decrease the DC voltage received by each of the light-emitting unit strings.

According to an embodiment of the present disclosure, the number of the light-emitting unit string is smaller than the number of the light-emitting units included in each of the light-emitting unit strings. The light-emitting device control method further includes: when it is determined that the number (m−1)*(x−p+1) of the shorted light-emitting units of all light-emitting unit string other than the specific string is larger than or equal to the number (n−x) of the light-emitting units which are not shorted in the specific string, turning off the specific string directly.

According to another embodiment of the present disclosure, the step of shorting the malfunctioned light-emitting units in specific string further includes: determining whether a normally operating one of the light-emitting units in the specific string is shorted, so as to reconnect the normally operating one when the normally operating one is shorted. The light-emitting device control method further includes: determining whether there is at least one normally operating light-emitting unit shorted in the light-emitting units of the specific string, so that when the number k of the normally operating light-emitting unit is smaller than or equal to x, the normally operating light-emitting unit is reconnected, and when k is larger than x, the x normally operating light-emitting unit is reconnected.

According to yet another embodiment of the present disclosure, the step of shorting the malfunctioned light-emitting units in the specific string further includes: shorting one of the light-emitting units of the specific string in order, and determining whether the normally operating light-emitting unit is shorted according to the voltage drop value across the current control unit.

According to further an embodiment of the present disclosure, the step of shorting the light-emitting units in each of the light-emitting unit strings other than the specific string further includes: determining whether there is a shorted light-emitting unit in the light-emitting units in each of the light-emitting unit strings other than the specific string, when the number q of the shorted light-emitting unit is larger than or equal to (x−p+1), the shorting is not performed, and when the number q of the shorted light-emitting unit is smaller than (x−p+1), shorting (x−p+1−q) light-emitting units which are not shorted.

According to another embodiment of the present disclosure, the light-emitting device control method further includes: when a malfunction condition is occurred in y light-emitting unit strings, the number of malfunctioned light-emitting units of each of the y light-emitting unit string is z, and the condition of $((m-1)*(x-p+1)-z)\geq((n-x)*y+(p-1)*(y-1))$ is met, turning off the y light-emitting unit strings.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
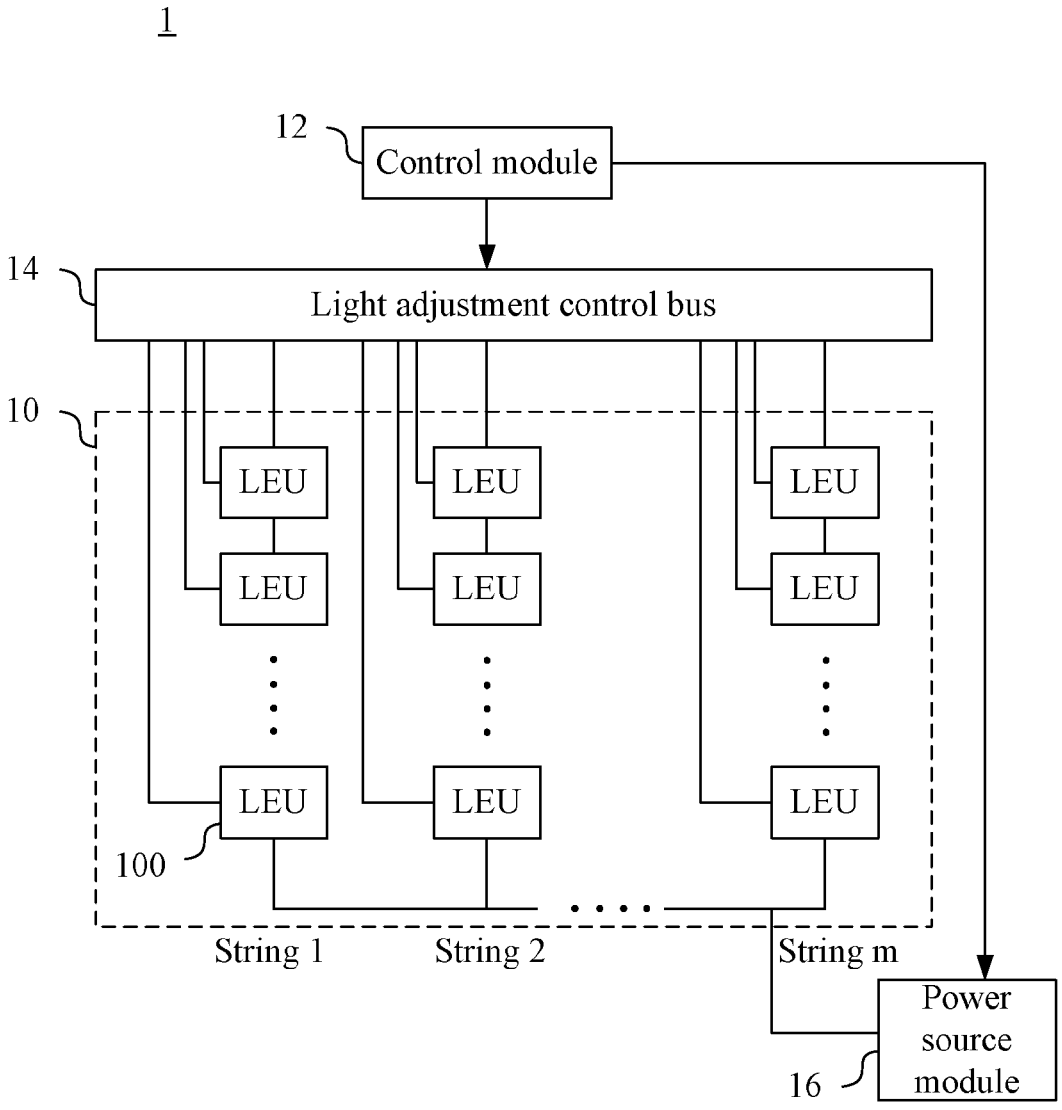
FIG. 1A is a circuit diagram of a light-emitting device in an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1A is a circuit diagram of a light-emitting device 1 in an embodiment of the present disclosure. The light-emitting device 1 includes: a light-emitting module 10, a control module 12 and a light adjustment control bus 14.

The light-emitting module 10 includes a plurality of strings of light-emitting units, shown in FIG. 1A as String 1, String 2, . . . , and String m. Each of the light-emitting unit strings includes a plurality of light-emitting units 100 connected in series.

In the present embodiment, the light-emitting module 10 includes m light-emitting unit strings, and each of the light-emitting unit strings has n light-emitting units 100 (depicted as LEU in FIG. 1A) arranged in the form of an array having m columns and n rows. The light-emitting unit strings may emit light according to a current respectively and produce a uniform light. In the present embodiment, the number m of the light-emitting unit strings is smaller than the number n of the light-emitting units 100 included in each of the light-emitting unit strings. The light adjustment control bus 14 may be used to control the current of each of the light-emitting unit strings such that the emission of the light from the light-emitting unit strings becomes stable. In the present embodiment, the light-emitting device 1 further includes a power source module 16 to provide power to the light-emitting module 10 to enable the light-emitting module 10 to emit light. An end of each of the light-emitting unit strings of the light-emitting module 10 is connected to the power source module 16.

Figure 1B:
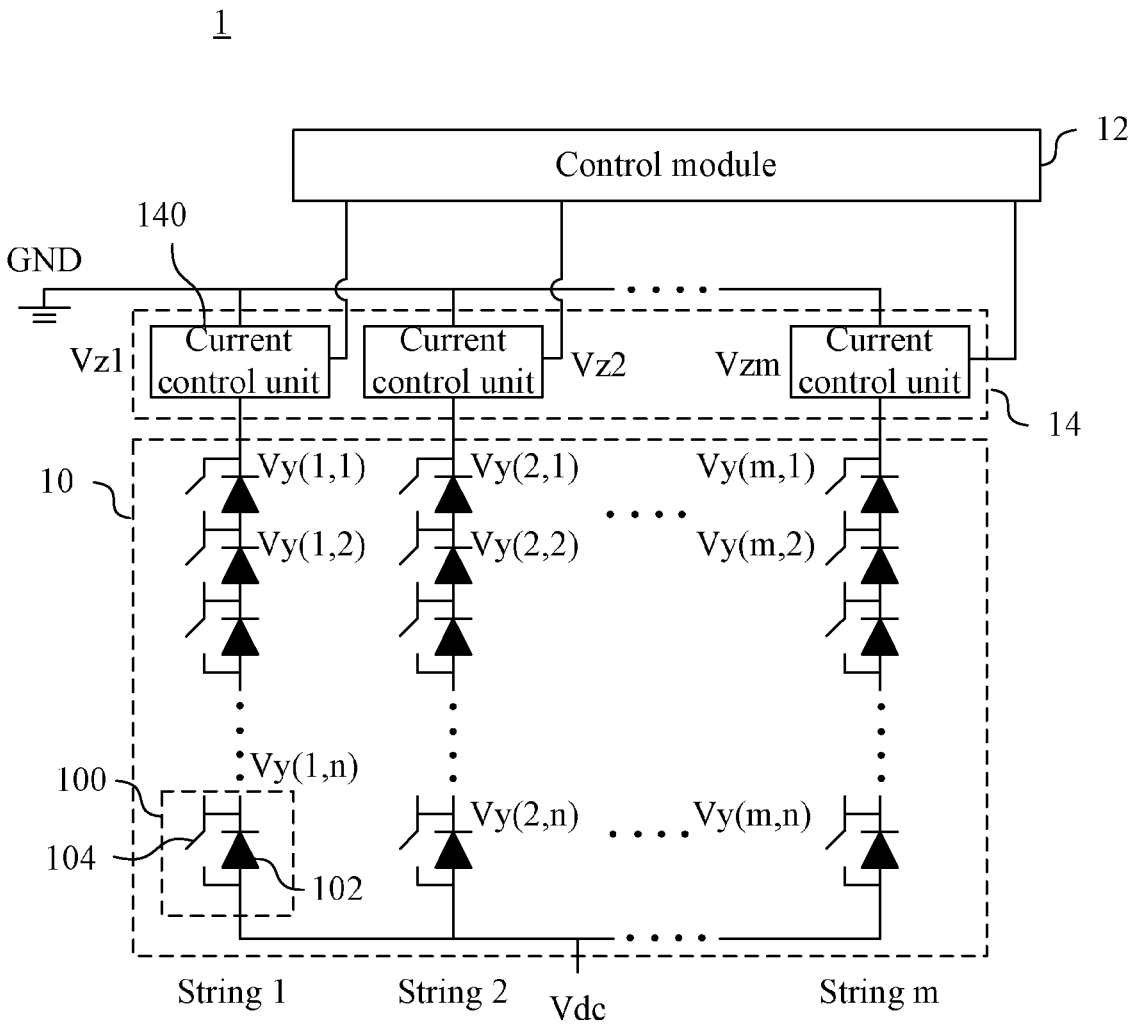
FIG. 1B is a detailed circuit diagram of the light-emitting device in the embodiment of the present disclosure.

FIG. 1B is a detailed circuit diagram of the light-emitting device 1 in an embodiment of the present disclosure. In the present embodiment, the light adjustment control bus 14 includes a plurality of current control units 140. Each of the current control units 140 is connected in series to the light-emitting units 100 in the corresponding light-emitting unit string to control the current passing through the light-emitting unit string. In the present embodiment, the current control units 140 may control the current of the light-emitting unit string at a constant value, so that the emission of the light from the light-emitting unit is string becomes stable.

An end of each of the light-emitting unit strings receives a same DC voltage Vdc, and the other end is connected to a ground terminal GND through the current control unit 140. The DC voltage Vdc may be provided by the power source module 16 in FIG. 1A. Each of the light-emitting units 100 in the light-emitting unit strings includes a light-emitting element 102 and a parallel switch 104. The light-emitting element 102 may be a solid state light-emitting unit, for example, the light-emitting diode (LED) and the organic LED (OLED).

In different embodiments, the light-emitting elements 102 may be implemented by different solid state light-emitting units. The parallel switch 104 and the light-emitting element 102 are connected in parallel. When the parallel switch 104 is disabled and the light-emitting element 102 does not malfunction, the light-emitting element 102 functions normally; and when the parallel switch 104 is enabled, the light-emitting element 102 is shorted no matter being in a normal state or a malfunctioned state.

In an embodiment, the control module 12 may control the parallel switch 104 through the light adjustment control bus 14 to enable or disable the parallel switch 104. In other embodiments, the parallel switch 104 may be controlled in other ways.

The light-emitting units 100 and the current control units 140 are operated according to the currents generated corresponding to the DC voltage Vdc, so that when the light-emitting module 10 is operated, both of the light-emitting units 100 and the current control units 140 produce a voltage drop value. In FIG. 1B, the voltage drop value produced by each of the light-emitting units 100 is represented as Vy(a,b), in which a and b represent the positions of the light-emitting unit 100 in the light-emitting module 10. For example, the voltage drop value produced by the light-emitting unit 100 located at Column 1, Row 1 (that is, the first light-emitting unit in String 1) is Vy(1,1), while the voltage drop value produced by the light-emitting unit 100 located in Column m, Row n is Vy(m,n). On the other hand, the voltage drop values produced by the current control units 140 corresponding to the 1st light-emitting unit string to the m-th light-emitting unit string are represented as Vz1 to Vzm respectively.

The control module 12 retrieves the voltage drop value across the current control unit 140 corresponding to each of the light-emitting unit strings, so as to further determine whether the light-emitting units 100 of each of the light-emitting unit strings malfunction. It should be noted that, the malfunction of the light-emitting units 100 actually stands for situation that the light-emitting element 102 fails to operate. Because each of the light-emitting unit strings is operated according to the same DC voltage Vdc, the total voltage drop value of each of the light-emitting unit strings is the same. When one light-emitting unit 100 in the light-emitting unit string malfunctions, the voltage drop value of the malfunctioned light-emitting unit is transferred to the corresponding current control unit 140 of the same string since the light-emitting unit 100 fails to operate. Therefore, by retrieving the voltage drop value across the current control unit 140 (that is, the voltage drop value of the current control unit 140) and determining whether the voltage drop value rises, the control module 12 determines whether a light-emitting unit 100 malfunctions.

For example, when the light-emitting unit 100 at Column 1, Row 2 malfunctions, the voltage drop value across the corresponding current control unit 140 becomes Vz1+Vy(1,2). If the number x of the malfunctioned light-emitting units 100 in the same string is larger than or equal to one malfunction threshold value p, the corresponding current control unit 140 is damaged for being unable to withstand such a high voltage. The entire light-emitting unit string fails to operate accordingly. In an embodiment, the malfunction threshold value p is 2, which means that when the number of the malfunctioned light-emitting units 100 in the same string is larger than or equal to 2, the corresponding current control unit 140 is damaged.

Accordingly, if the number x of malfunctioned light-emitting units exceeds the malfunction threshold value p, the total light-emitting units 100 of the entire string are turned off and the brightness of the entire string is lost for only one or two malfunctioned light-emitting units 100, which significantly reduces the light-emission efficiency of the entire light-emitting module 10. For example, when the number m of the light-emitting unit strings in the light-emitting module 10 is 4, and the number n of the light-emitting units 100 in each string is 13, if the number x of malfunctioned light-emitting units in a string is 2, the brightness provided by the thirteen light-emitting units 100 is lost when the string is turned off directly, Therefore, in the present invention, when it is determined that a malfunction condition is occurred in one of the light-emitting unit string and the number x of the malfunctioned light-emitting units is larger than or equal to the malfunction threshold value p, the control module 12 shorts the malfunctioned light-emitting units 100 in the string, and shorts (x−p+1) light-emitting units in each of the light-emitting unit strings other than the string at the same.

Figure 2:
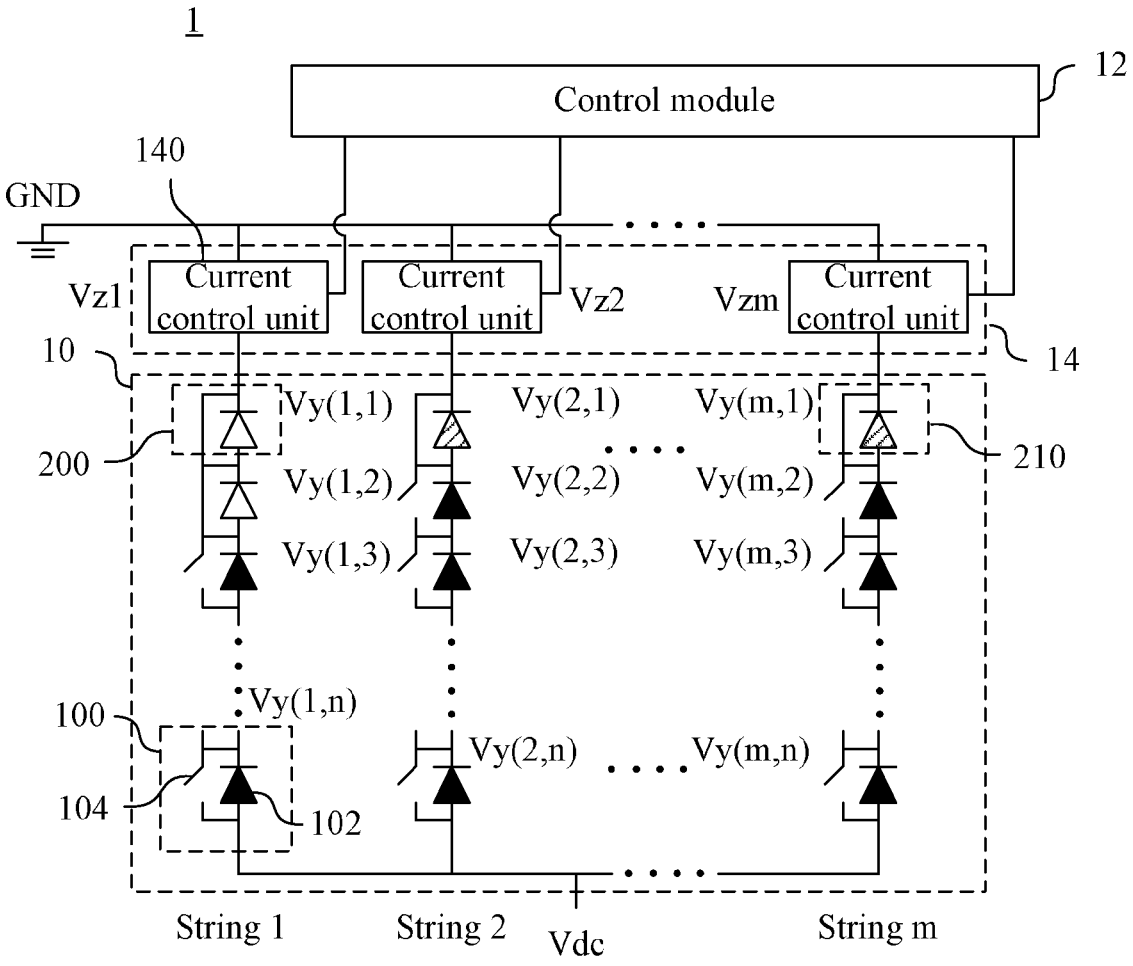
FIG. 2 is a circuit diagram of a light-emitting unit string having the malfunction condition in the light-emitting module in an embodiment of the present disclosure.

FIG. 2 is a circuit diagram of a light-emitting unit string having the malfunction condition in the light-emitting module 10 in an embodiment of the present disclosure.

For example, when the control module 12 determines that the light-emitting units at the positions of Column 1,Row 1 and Column 1, Row 2 (i.e. the light-emitting units having the voltage drop values of Vy(1,1) and Vy(1,2)) in the light-emitting module 10 are the malfunctioned light-emitting units 200, the control module 12 controls the parallel switches 104 that are connected in parallel to the malfunctioned light-emitting units 200, to short the malfunctioned light-emitting units 200. In addition, the control module 12 further shorts one (2−2+1=1) light-emitting unit of each the light-emitting unit strings from Column 2 to Column m. In the present embodiment, the control module 12 shorts the light-emitting units 210 at Row 1 in each of the strings from Column 2 to Column m (i.e. the light-emitting units having the voltage drop values of Vy(2,1), . . . , and Vy(m,1)). It should be noted that, the light-emitting units can be shorted by the control module 12 by enabling the parallel switches 104.

Therefore, in addition to the two light-emitting units 100 in String 1, each the other strings has one light-emitting unit 100 that is shorted and fails to operate. Since the light-emitting units that consume the current to cause the voltage drop in each of the light-emitting unit strings are reduced, the control module 12 may further adjust and decrease the DC voltage Vdc to prevent the to light-emitting units in each of the light-emitting unit strings from damage such that each of the other light-emitting units 100 in the light-emitting unit strings can still operate normally.

Suppose that the number m of the light-emitting unit strings is 4 and the number n of the light-emitting units 100 in each of the light-emitting unit strings is 13, when the malfunction condition occurs, only two light-emitting units of String 1 and one light-emitting unit in each of the light-emitting unit strings from String 2 to String 4, i.e. five light-emitting units 100 in total, need to be turned off by using the method of the present invention. Comparing to the method of turning off the thirteen light-emitting units 100 (including the malfunctioned one) in String 1 directly, the decrease of the lighting efficiency due to the malfunctioned light-emitting units can be greatly improved by using the method of the present invention.

By using the method described above, if the number of malfunctioned light-emitting units 100 in a specific string is 3 (x=3) and the malfunction threshold value is 2 (p=2), the control module 12 shorts two light-emitting units ((x−p+1)=(3−2+1)=2) in each of the light-emitting unit strings other than the specific string in addition to the three malfunctioned light-emitting units.

However, in an embodiment, when the control module 12 determines that the number x of the malfunctioned light-emitting units is too large such that it is not beneficial to turn off the light-emitting units 100 in other strings, the entire light-emitting unit string may also be turned off directly. In other words, when the number of the light-emitting units 100 that are not shorted in the specific string that includes the x malfunctioned light-emitting units is (n−x), the number of the light-emitting units 100 that need to be shorted is (m−1)*(x−p+1) by using the method described above. The control module 12 can turn off the specific string directly when it determines that the condition of (m−1)*(x−p+1)≥(n−x) is met.

For example, in an array having 4 columns and 13 rows (m=4; n=13) of light-emitting units, when the number of the malfunctioned light-emitting units in one of the light-emitting unit strings is 4 (x=4) and the malfunction threshold value is 2 (p=2), the number of the light-emitting units 100 which are not shorted is (n−x)=(13−4)=9. Therefore, (m−1)*(x−p+1)=(3)*(4−2+1)=9 light-emitting units need to be turned off by using the method described above. Therefore, the method described is not better than the method of turning off the specific string directly. Hence, when such a condition is met, the control module 12 may turn off the specific string directly.

In the same array mentioned above, when the number of the malfunctioned light-emitting units in one of the light-emitting unit strings is 5 (x=5), the number of the light-emitting units 100 which are not shorted is (n−x)=(13−5)=8. Therefore, (m−1)*(x−p+1)=(3)*(5−2+1)=12 units need to be turned off by using the method described above. The control module 12 may determine that the method of turning off the specific string directly is more efficient and turns off the specific string directly.

Figure 3:
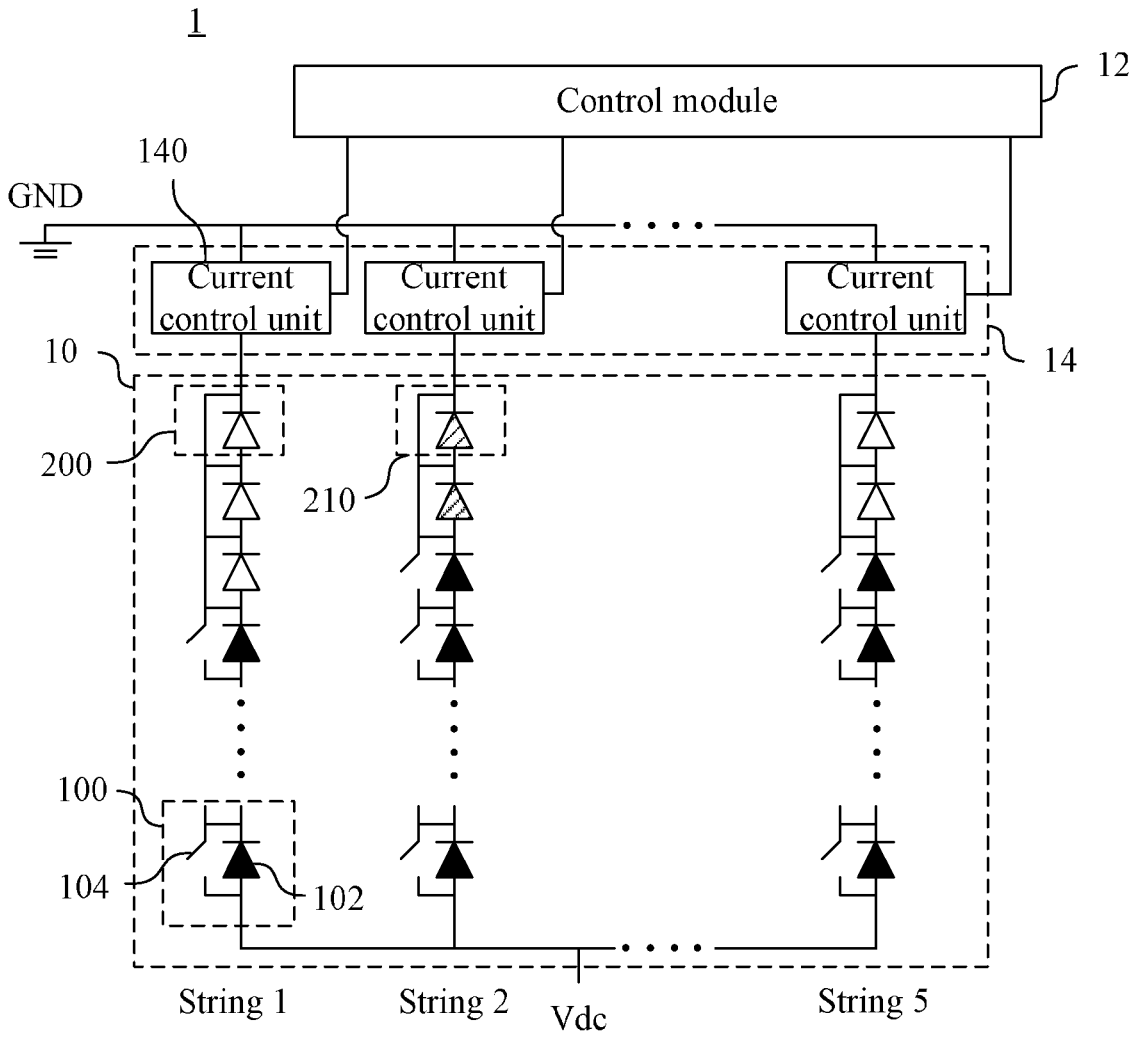
FIG. 3 is a circuit diagram of two malfunctioned light-emitting unit strings in a light-emitting module in an embodiment of the present disclosure.

FIG. 3 is a circuit schematic diagram of two malfunctioned light-emitting unit strings in the light-emitting module 10 in an embodiment of the present disclosure.

In the present embodiment, the light-emitting module 10 is an array having 5 columns and 13 rows (m=5; n=13) of light-emitting units, and the malfunction threshold value is 2 (p=2). The number of malfunction light-emitting units in two of the light-emitting unit strings in the light-emitting module 10, for example, String 1 and String 5 shown in FIG. 2, exceeds the malfunction threshold value p, in which two malfunctioned light-emitting units 200 are presented in String 5 and three malfunctioned light-emitting units 200 are presented in String 1. If the method of turning off the entire light-emitting unit strings directly is used, 26 light-emitting units 100 are shorted (including 5 malfunctioned ones and 21 normal ones that are turned off additionally). However, by using the method of the present invention, only 11 light-emitting units need to be shorted (including 5 malfunctioned light-emitting units 200 and 6 light-emitting units 210 that are turned off additionally).

In an embodiment, if the malfunction condition occurs in y light-emitting unit strings at the same time, and the number of the malfunctioned light-emitting units is z, the control module 12 further determines whether the following condition is met:

$$((m-1)*(x-p+1)-z)\geq((n-x)*y+(p-1)*(y-1)).$$

If the above condition is met, the control module 12 turns off the light-emitting unit string directly. If the condition is not met, the control module 12 only needs to short (x−p+1) light-emitting units 100 in other light-emitting unit strings.

The shorting mechanism performed by the control module 12 on the light-emitting units 100 is described in detail below.

In an embodiment, the control module 12 stores a reference table (not shown) to record the shorted light-emitting units 100 in each of the light-emitting unit strings and whether the shorted light-emitting units 100 actually malfunction. Since the control module 12 determines whether the light-emitting unit 100 malfunctions according to the voltage drop value across the current control unit 140 corresponding to each of the light-emitting unit strings, the control module 12 can only determine whether the malfunction condition occurs and can not determine which light-emitting unit that actually malfunctions. Therefore, during the shorting process, the control module 12 shorts the light-emitting units 100 in the single string one by one in order. The control module 12 further checks whether the voltage drop value across the current control units 140 further rises to determine whether a light-emitting unit 100 that operates normally is turned off.

When the light-emitting unit 100 that operates normally is turned off, the original voltage drop value is transferred to the current control unit 140 such that the voltage drop value across the current control unit 140 rises. Therefore, the control module 12 disables the parallel switch 104 of the light-emitting unit 100 again to reconnect the light-emitting unit 100 such that the light-emitting element 102 continues to operate normally. However, when the control module 12 determines that the voltage drop value across the current control unit 140 does not rise, the control module 12 determines that the shorted light-emitting unit 100 is the malfunctioned light-emitting unit 200. The control module 12 further records the shorting result in the reference table.

In an embodiment, the control module 12 further determines whether a light-emitting unit 100 that is able to operate normally is shorted in one specific string according to the reference table. When a light-emitting unit 100 in the specific string malfunctions, the control module 12 further determines whether the number k of the normally operating light-emitting units that is shorted is smaller than or equal to the number x of the malfunctioned light-emitting units 100.

When k is smaller than x, the control module 12 shorts the malfunctioned light-emitting units 200 and reconnects the shorted light-emitting units that are able to operate normally. However, when k is larger than x, the control module 12 shorts the malfunctioned light-emitting units 200 and reconnects x shorted light-emitting units among the k shorted light-emitting units that are able to operate normally. The control module 12 further modifies the reference table and stores the new shorting results therein.

For the light-emitting unit strings other than the specific string, the control module 12 also performs the shorting process according to the reference table.

In an embodiment, when the control module 12 performs the shorting process on the light-emitting unit strings other than the specific string, the control module 12 determines whether there is a shorted light-emitting unit 100 in each of the light-emitting unit strings according to the reference table. When there are shorted light-emitting units 100 and the number q of the shorted light-emitting units 100 is larger than or equal to (x−p+1), the control module 12 does not perform shorting, and when the number q of the shorted light-emitting units of the light-emitting units is smaller than (x−p+1), the control module 12 shorts (x−p+1−q) light-emitting units which are not shorted.

For example, in an array having 4 columns and 13 rows (m=4; n=13) of light-emitting units, when the number of malfunctioned light-emitting units 100 in String 1 is 3 (x=3) and the malfunction threshold value is 2 (p=2), 2 ((x−p+1)=(3−2+1)=2) light-emitting units 100 in each of the light-emitting unit strings from String 2 to String 4 are about to be shorted, respectively. In such a condition, if more than two light-emitting units 100 have already been shorted in any one of the light-emitting unit strings of String 2 to String 4, the control module 12 does not need to short any other light-emitting units 100 in that string. However, when only one light-emitting unit 100 in one of the light-emitting unit strings other than the specific string has been shorted, the control module 12 only needs to short one ((x−p+1−q)=(3−2+1−1)=1) of the rest of the light-emitting units 10 which are not shorted in that string.

Therefore, with the aid of the mechanism described above, the light-emitting module 10 can be controlled in a flexible way, and the brightness of the light-emitting module 10 can be maintained as much as possible and the damage of the light-emitting units can be avoided.

It should be noted that, in the above embodiments, the condition of one current control unit corresponding to one light-emitting unit string is merely an example. In other embodiments, one current control unit may correspond to two or more than two light-emitting unit strings that are connected in parallel. The control module can control and adjust the operation of the light-emitting units by using the method described above.

Figure 4:
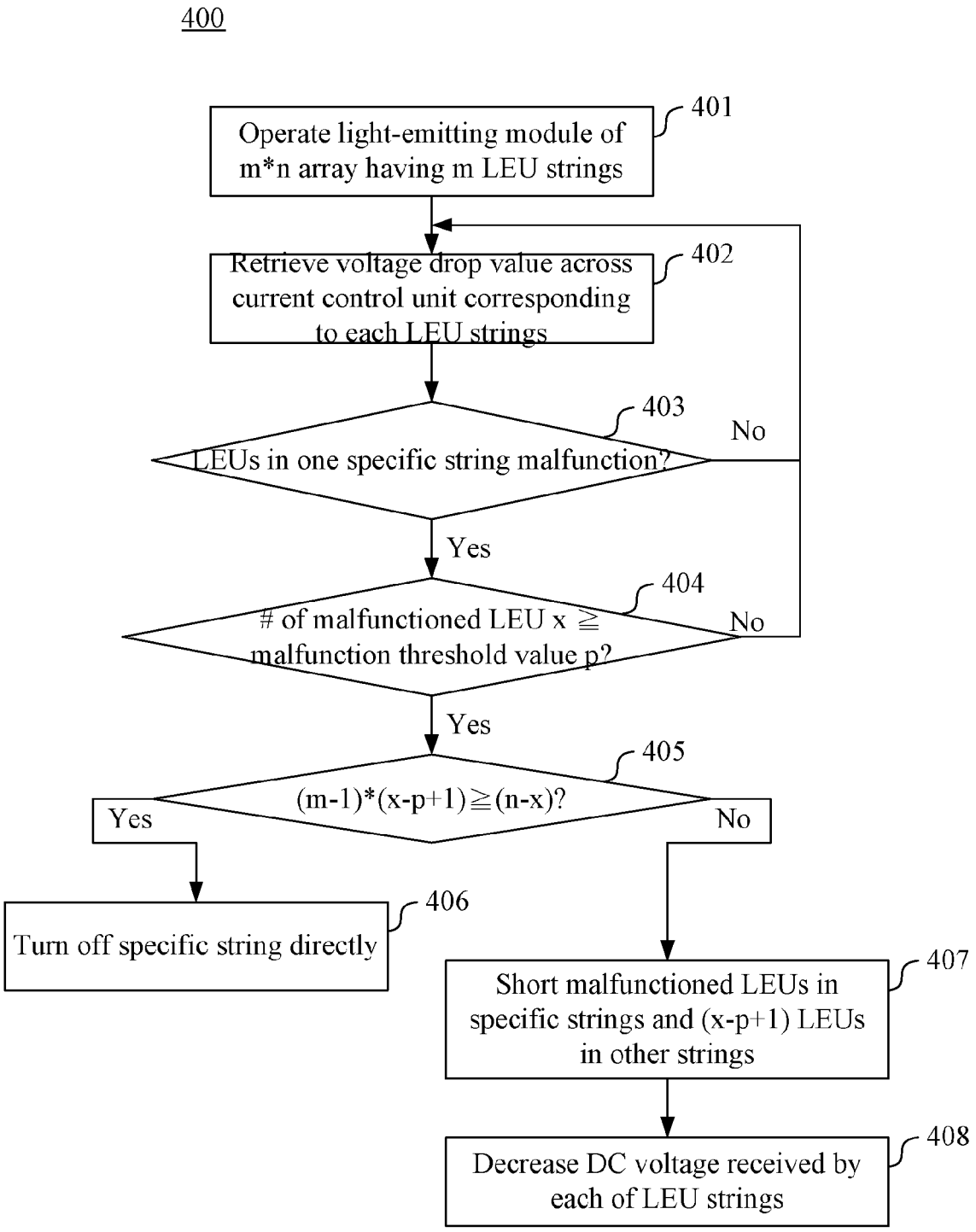
FIG. 4 is a flow chart of a light-emitting device control method in an embodiment of the present disclosure.

FIG. 4 is a flow chart of a light-emitting device control method 400 in an embodiment of the present disclosure. The light-emitting device control method 400 may be applied to the light-emitting device 1 shown in FIG. 1A and FIG. 1B. However, the present invention is not limited thereto. The light-emitting device control method 400 includes the following steps (it should be understood that, unless the sequence of steps is specified for the steps mentioned in the present disclosure, the sequence of the steps may be adjusted as required in practice, and even all the steps of a part of the steps may be executed simultaneously, and the present disclosure is not limited thereto).

In Step 401, the light-emitting module 1 having an array of m columns and n rows of light-emitting units (LEUs) 100 is operated.

In Step 402, the control module 12 retrieves the voltage drop value is across the current control unit 140 corresponding to each of the light-emitting unit strings, so as to further determine whether the light-emitting units 100 of each of the light-emitting unit strings malfunction in Step 403. When the light-emitting units of the specific string do not malfunction, the flow returns to Step 402.

When the light-emitting units of the specific string malfunction, the control module 12 determines whether the number x of malfunctioned light-emitting units is larger than or equal to a malfunction threshold value p in Step 404. When the number of malfunctioned light-emitting units is smaller than the malfunction threshold value p, the control module 12 does nothing and the flow returns to Step 402.

When the control module 12 determines that the number x of malfunctioned light-emitting units is larger than or equal to malfunction threshold value p in Step 403, the control module 12 further determines whether the number of the shorted light-emitting units of each of the light-emitting unit strings other than the specific string having the malfunction light-emitting units is larger than or equal to the number of the light-emitting units 100 which are not shorted in the specific string in Step 405. That is, whether the following condition is met is determined:

$$(m-1)*(x-p+1)\geq(n-x).$$

When the condition is met, the control module 12 turns off the specific string directly in Step 406.

When the condition is not met, the control module 12 shorts the malfunctioned light-emitting units 200 in the specific string and shorts (x−p+1) of the light-emitting units 210 in each of the light-emitting unit strings other than the specific string in Step 407, and decrease the DC voltage Vdc received by each of the light-emitting unit strings in Step 408.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A light-emitting device, comprising:

a light-emitting module, comprising a plurality of light-emitting unit strings, each of the light-emitting unit strings comprising a plurality of light-emitting units connected in series, wherein an end of each of the light-emitting unit strings receives a same DC voltage;

a light adjustment control bus, comprising a plurality of current control units, each being connected in series to at least one of the light-emitting unit strings, so as to control a current of each of the light-emitting unit strings;

a control module, configured to retrieve a voltage drop value across each of the current control units, so as to further determine whether the light-emitting units in each of the light-emitting unit strings malfunction; and when the light-emitting units of a specific string among the light-emitting unit strings malfunction, and the number x of malfunctioned light-emitting units is larger than or equal to a malfunction threshold value p, the control module shorts the malfunctioned light-emitting units in the specific string and shorts (x−p+1) light-emitting units in each of the light-emitting unit strings other than the specific string, so as to decrease the DC voltage received by each of the light-emitting unit strings.

2. The light-emitting device according to claim 1, wherein a number m of the light-emitting unit strings is smaller than a number n of the light-emitting units comprised in each of the light-emitting unit strings.

3. The light-emitting device according to claim 2, wherein when the control module determines that the number (m−1)*(x−p+1) of the shorted light-emitting units of all light-emitting unit string other than the specific string is larger than or equal to the number (n−x) of the light-emitting units which are not shorted in the specific string, the control module turns off the specific string.

4. The light-emitting device according to claim 1, wherein each of the light-emitting units further comprises a light-emitting element and a parallel switch, and the control module shorts the corresponding light-emitting element by enabling the parallel switch.

5. The light-emitting device according to claim 1, wherein the control module stores a reference table to record at least one shorted light-emitting unit of each of the light-emitting unit strings and whether the short light-emitting unit is malfunctions.

6. The light-emitting device according to claim 5, wherein the control module determines whether one of the normally operating light-emitting units in the specific string is shorted when shorting the specific string, and reconnects the normally operating one when the normally operating one is shorted.

7. The light-emitting device according to claim 6, wherein the control module further determines whether there is at least one normal operating light-emitting unit shorted in the light-emitting units of the specific string according to the reference table, so that when a number k of the normally operating light-emitting unit is smaller than or equal to x, the normally operating light-emitting unit is reconnected, and when k is larger than x, the normally operating light-emitting unit is reconnected.

8. The light-emitting device according to claim 6, wherein the control module shorts one of the light-emitting units of the specific string in order, and determines whether the normally operating light-emitting unit is shorted according to the voltage drop value across the current control unit.

9. The light-emitting device according to claim 5, wherein the control module determines whether there is a shorted light-emitting unit in each of the light-emitting unit strings other than the specific string according to the reference table when each of the light-emitting unit strings other than the specific string is to be shorted, when a number q of the shorted light-emitting unit is larger than or equal to (x−p+1), the control module does not perform shorting, and when the number q of the shorted light-emitting unit among the light-emitting units is smaller than (x−p+1), the control module shorts (x−p+1−q) light-emitting units which are not shorted.

10. The light-emitting device according to claim 2, wherein when a malfunction condition occurs in y light-emitting unit strings, the number of malfunctioned light-emitting units is z, and the condition of $((m-1)*(x-p+1)-z)\geq((n-x)*y+(p-1)*(y-1))$ is met, the control module turns off the y light-emitting unit strings.

11. A light-emitting device control method, comprising:

operating a light-emitting module of a light-emitting device, wherein the light-emitting module comprises a plurality of light-emitting unit string, each of the light-emitting unit strings comprises a plurality of light-emitting units connected in series, and an end of each of the light-emitting unit strings receives a same DC voltage;

retrieving a voltage drop value across each of a plurality of current control units, so as to further determine whether the light-emitting units in each of the light-emitting unit strings malfunction, wherein each of the current control units and one of the light-emitting unit string are connected in series; and when the light-emitting units of a specific string among the light-emitting unit strings malfunction, and the number x of malfunctioned light-emitting units is larger than or equal to a malfunction threshold value p, shorting the malfunctioned light-emitting units in the specific string and shorting (x−p+1) light-emitting units in each of the light-emitting unit strings other than the specific string, so as to decrease the DC voltage received by each of the light-emitting unit strings.

12. The light-emitting device control method according to claim 11, wherein a number m of the light-emitting unit strings is smaller than a number n of the light-emitting units comprised in each of the light-emitting unit strings.

13. The light-emitting device control method according to claim 12, further comprising: when it is determined that the number (m−1)*(x−p+1) of the shorted light-emitting units of all light-emitting unit string other than the specific string is larger than or equal to the number (n−x) of the light-emitting units which are not shorted in the specific string, turning off the specific string.

14. The light-emitting device control method according to claim 11, wherein the step of shorting the specific string further comprises: determining whether one of the normally operating light-emitting units in the specific string is shorted, and reconnecting the normally operating one when the normally operating one is shorted.

15. The light-emitting device control method according to claim 14, further comprising: determining whether there is at least one normally operating light-emitting unit shorted in the light-emitting units of the specific string, so that when the number k of the normally operating light-emitting units is smaller than is or equal to x, the normally operating light-emitting unit is reconnected, and when k is larger than x, the x normally operating light-emitting units is reconnected.

16. The light-emitting device control method according to claim 14, wherein the step of shorting in the specific string further comprises: shorting one of the light-emitting units of the specific string in order, and determining whether the normally operating light-emitting unit is shorted according to the voltage drop value across the current control unit.

17. The light-emitting device control method according to claim 11, wherein the step of shorting the light-emitting units in each of the light-emitting unit strings other than the specific string further comprises: determining whether there is a shorted light-emitting unit among the light-emitting units in each of the light-emitting unit strings other than the specific string, when a number q of the shorted light-emitting unit is larger than or equal to (x−p+1), the shorting is not performed, and when the number q of the shorted light-emitting unit is smaller than (x−p+1), shorting (x−p+1−q) light-emitting units which are not shorted.

18. The light-emitting device control method according to claim 12, wherein when a malfunction condition occurs in y light-emitting unit strings, the number of malfunctioned light-emitting units is z, and the condition of $((m-1)*(x-p+1)-z)\geq((n-x)*y+(p-1)*(y-1))$ is met, the control module turns off the y light-emitting unit strings.

* * * * *